US008141395B2

(12) United States Patent
Dillavou

(10) Patent No.: US 8,141,395 B2
(45) Date of Patent: Mar. 27, 2012

(54) ARTICLE OF CLOTHING WITH APERTURE

(76) Inventor: Michelle Marie Dillavou, Chicago, IL (US)

( * ) Notice: Subject to any disclaimer, the term of this patent is extended or adjusted under 35 U.S.C. 154(b) by 184 days.

(21) Appl. No.: 12/707,663

(22) Filed: Feb. 17, 2010

(65) Prior Publication Data

US 2010/0205715 A1 Aug. 19, 2010

Related U.S. Application Data

(60) Provisional application No. 61/207,741, filed on Feb. 17, 2009.

(51) Int. Cl.
*D04B 1/24* (2006.01)

(52) U.S. Cl. ..... 66/171; 2/195.8

(58) Field of Classification Search ..... 66/169 R, 66/170, 171; 2/175.1, 195.7, 195.8, 195.1
See application file for complete search history.

(56) References Cited

U.S. PATENT DOCUMENTS 1,785,637 A * 12/1930 Lipper ..... 66/171
1,906,212 A * 4/1933 Lacks et al. ..... 66/171
2,133,619 A * 10/1938 Hutton ..... 2/172
2,149,655 A * 3/1939 Yamaguchi ..... 66/171
2,264,594 A * 12/1941 Schuessler ..... 2/172
2,664,725 A * 1/1954 Schuessler ..... 66/171
3,898,699 A * 8/1975 Zientara et al. ..... 2/175.1
4,141,229 A * 2/1979 Sharpe ..... 66/171
4,571,959 A * 2/1986 Chesebro et al. ..... 66/169 R
5,321,854 A * 6/1994 Kronenberger ..... 2/209.7
5,509,145 A 4/1996 Stevenson et al.
5,511,249 A * 4/1996 Higgins ..... 2/209.7
D374,758 S * 10/1996 Armenta et al. ..... D2/891
5,644,799 A * 7/1997 Armenta et al. ..... 2/209.13
5,799,334 A 9/1998 Griffith et al.
5,875,494 A * 3/1999 Garnier et al. ..... 2/209.7
5,960,477 A 10/1999 Dixon
D420,207 S * 2/2000 Barton et al. ..... D2/889
6,240,566 B1 6/2001 Scantlin
6,401,255 B1 6/2002 Douglas
6,463,592 B1 10/2002 Brooks
6,681,601 B2 * 1/2004 Li ..... 66/171
6,711,749 B2 * 3/2004 White et al. ..... 2/195.8
7,024,702 B2 4/2006 Kronenberger
7,114,195 B1 10/2006 Grandison
D546,031 S * 7/2007 Pearson et al. ..... D2/876
D564,183 S * 3/2008 Roach et al. ..... D2/865
D577,879 S * 10/2008 Jones ..... D2/889
D589,687 S * 4/2009 Hoeppner ..... D2/878
D595,033 S * 6/2009 Lynn ..... D2/889
D624,285 S * 9/2010 Hall ..... D2/875
7,945,971 B2 * 5/2011 Garza ..... 2/209.3
2010/0205715 A1 * 8/2010 Dillavou ..... 2/69

* cited by examiner

*Primary Examiner* — Danny Worrell
(74) *Attorney, Agent, or Firm* — Roger A. Jackson

(57) ABSTRACT

An article and method is disclosed having a yarn knitted into a fabric panel including a base plurality of rows, a descending plurality of rows, and an ascending plurality of rows. The panel having interior and exterior surfaces, a first and a partially adjacent second margin. Included is an aperture therethrough from the interior to the exterior, the aperture is disposed in a portion of the first and second margins. The aperture forms an aperture periphery, wherein the descending and ascending rows correspond to the aperture periphery and the first and second margins correspond to the base rows. The descending rows each decrease by at least a stitch from the base rows and the ascending rows each increase by at least a stitch from the descending rows, wherein the aperture periphery forms a smooth transition from the exterior to the interior while having no reduction in panel stretching flexibility.

6 Claims, 15 Drawing Sheets

ARTICLE OF CLOTHING WITH APERTURE

RELATED APPLICATION

This application claims priority from U.S. provisional patent application Ser. No. 61/207,741 filed Feb. 17, 2009 by Michelle Marie Dillavou.

TECHNICAL FIELD

The present invention relates generally to an article of clothing with a hidden seam and hidden aperture margin for the purpose of using the aperture as a convenient outlet for an ancillary item. More specifically, the present invention relates to an article of clothing such as a knitted head stocking cap having an aperture sized and configured for feeding therethrough a wearer hair ponytail, thus allowing the article to have a retained close fit upon the wearer's head. Thus the article is comfortable to wear, provides better warmth from cold weather due to the close fitting nature of the article to the wearer's head, and helps to retain the article to the wearer's head via the wearer's hair ponytail being disposed therethrough the aperture, especially when the wearer is engaging in sporting activities.

BACKGROUND OF INVENTION

The conventional head stocking cap typically has an inherent problem of working its way loose from the wearer's head during use and especially so when the wearer's use involves sporting activities. This working loose of the stocking cap occurs from two basic inherent features of the stocking cap; being the frustoconical shape of the wearer's head, i.e. tapering conically inward from the ears upward, and the compressive nature of the stocking cap as against the wearer's head, this coupled with the low surface frictional aspect of smooth hair on the wearer's head from the ears upward goes to the stocking cap essentially "squeezing off" of the wearer's head in an upward manner. The squeezing off of the stocking cap is exacerbated by the wearer further engaging in sporting activities, i.e. rapid jerking movements in all three axes, such as during skiing, snowboarding, sledding, running, bicycling, rollerblading, walking, and the like. Of course this squeezing off of the stocking cap from the wearer's head varies by the particular shape of the wearer's head, either being somewhat tapered from the ears upward to highly tapered from the ears upward, also the coefficient of friction of the stocking cap to the wearer's hair, and the amount of inward compression circumferentially of the stocking cap as against the wearer's head, wherein higher compression results in a stronger tendency of the stocking cap to squeeze off of the wearer's head. Thus this squeezing off of the stocking cap from the wearer's head is at least inconvenient, and can possibly cause the loss of the stocking cap from the wearer's head.

This squeezing off problem has been recognized in the stocking cap arts by the introduction of a retaining extensions going from the bottom of each ear covering flap, wherein the pair of retaining extensions are secured together underneath the wearer's chin, thus preventing the stocking cap from squeezing off of the wearer's head upwardly, as evidenced by a typical "Snowboarder's" cap. Of course this style of stocking cap with the retaining extensions adds its own problems with chaffing and discomfort as against the wearer's chin and the hassle of tying and untying the retaining extensions.

On the circumferential compression of the stocking cap, as previously mentioned if it is high, the squeezing off of the cap is made worse, although there is some benefit in increasing the frictional force of the stocking cap as against the wearer's head; where the force against the hair is increasing by virtue of the normal force increasing from the cap to the head via the typical frictional force equation of frictional force=the coefficient of friction multiplied by the normal force. However, a negative in increasing the normal force of the stocking cap is increased discomfort for the wearer from increased pressure against their head that can cause headaches and the like.

In the prior art, there are a number of multi-functional type hats, an example would be in U.S. Pat. No. 5,960,477 to Dixon that has a removable visor that is nested within a flap, in addition to fold down ear extensions for added warmth. Also, in this same area of multiple purpose hats see U.S. Pat. No. 6,463,592 to Brooks that is a multi-configurable head wear unit that has an inner and an outer knit fabric tube with a removable visor that is attached through an opening in the inner tube to provide support for the visor in the annular space in-between the inner and outer tubes.

Further, in the prior art in the unique materials and layering area see U.S. Pat. No. 7,114,195 to Grandison that discloses an infant's hat for a newborn that is made of multilayered construction having a fabric layer such as cotton followed by an insulating plastic layer with an adhesive layer therebetween.

Also, in the prior art looking at the hats with openings, say for a hair ponytail, there are a number of different types, although most all of these are related to baseball type hats, which are a relatively thin layer of fabric that normally has very little stretch in it, as the baseball cap usually has an adjustable band in the lower back, or without the band being present, comes in multiple sizes to accommodate different wearer's head sizes. Some examples would be in U.S. Pat. No. 5,509,145 to Stevenson et al., that has a crown opening in the top of the baseball cap for a ponytail, wherein the crown opening has a stowable plug that can cover the crown opening when not in use. Another prior art example in the area of baseball caps would be in U.S. Pat. No. 5,799,334 to Griffith et al., that has a pair of hair pigtail openings that are closable when not in use via using flaps and hook and loop fasteners. A further example in this area of hair pony tail openings in baseball caps is in U.S. Pat. No. 6,240,566 to Scantlin that has the entire rear section of the baseball cap removed, basically creating the entire back half of the cap as a hair pigtail opening, while retaining the cap with the conventional adjustable band. Yet another prior art example in baseball caps for hair ponytail opening see U.S. Pat. No. 7,024,702 to Kronenberger that is similar to Scantlin, however, being more of a visor style in the rearward section of the cap, i.e. clamping semi-peripherally around the wearer's head with flexible extensions.

In a deviation from the baseball cap type hat with a hair ponytail opening, being more of a soft cap not having a visor see U.S. Pat. No. 6,401,255 to Douglas that has a multitude of folding flaps that attach to one another through hook and loop fasteners, wherein openings are created in the flap folds that accommodate a hair ponytail opening, although there would be some concern with the wearer's hair getting caught in the folds or the hook and loop fasteners causing wearer discomfort.

What is needed is a stocking cap with an aperture, however with the stocking cap being of knitted construction for comfort specifically relating to the circumferential compression of the stocking cap as against the wearer's head being better diffused as compared to fleece type material that is less flexible and therefore less adaptable to wearer's differing head sizes and shapes-especially since caps tend to come in just "one size fits all" which really isn't true at all. Further, the knitted stocking cap has the advantage of the ability to create an integral margin around the aperture via the use of the unique yarn weaving to form a smooth protrusion free exterior outer cap surface including the aperture, further this knitted margin is fully flexible or stretchable around the aperture which again adds to the comfort and flexibility available to the wearer as the size of the pony tail diameter will vary and the stretchable knitted margin makes inserting therethrough the aperture and removing the ponytail from the aperture that much easier.

Comparing this to the typical fleece material cap which is a combination of a polyester and spandex blend, wherein the base fleece material has a degree of flexible stretch, although in comparing the fleece stretch to the knit stretch, the fleece stretch is much more limited in strain or distance stretched and does not diffuse the stretching movement over nearly as much area as the knit stretch does, which leads to more wearer discomfort from the fleece having less stretching distance that is concentrated in a smaller area as against the wearer's head. This as compared to the knitted cap which has more stretching movement that is diffused over a larger area all leading to a lower unit area circumferential pressure against the wearer's head which means more comfort.

In addition, where the fleece has a margin, it requires a separate hem piece that is stitched onto the margin, in other words the fleece cannot just be cut on an edge and left that way, as the fleece has no way to create a self sealing edge from the integral fibers of the base material, as the knitted cap can uniquely stitch an edge with the base yarn material. This results in the fleece needing the separately stitched hem piece where ever there is an edge, this has several negative effects; firstly, it significantly affects the stretch ability of the fleece at the hemmed margin by restricting the stretch distance from both the tripling of fleece layers at the margin via the hem sandwiching the base fleece piece, which reduces the stretch distance by two-thirds. Secondly, further adding the stitching in this area of the hem to attach the hem to the base fleece piece also acts to reduce the stretching ability, even stretch (loose) stitching only reduces the stitching reduction of stretch ability, thus the fleece margin still is considerably more resistance to flexible stretching than the knitted cap.

As applied to the aperture in the cap, and specifically the aperture margin, the fleece cap will have significantly less stretch be at least two thirds than the knitted cap which results in the fleece cap having less accommodation of different diameter ponytails, also more difficulty in inserting through and removing from the aperture of the ponytail, in addition to the fleece having more circumferential pressure as against the head of the wearer adding discomfort due to the lower amount of stretch that is more area concentrated, resulting in the fleece cap being more uncomfortable to wear and more difficult to place the ponytail in through the aperture and remove the ponytail back out of the aperture.

SUMMARY OF INVENTION

Broadly, the present invention is an article of clothing with an aperture, that includes a yarn knitted into a fabric panel including a base plurality of rows, a descending plurality of rows, and an ascending plurality of rows. The fabric panel having an interior surface, an exterior surface, a first margin, and a second margin, wherein the first and second margins are partially adjacent to one another. Further included is an aperture therethrough from the interior surface to the exterior surface, the aperture is disposed in a portion of the first and second margins, wherein the aperture is defined by an aperture first margin and an aperture second margin that respectively replace a portion of the first margin and the second margins. Wherein the aperture first margin and the aperture second margin combined form an aperture periphery, wherein the descending and ascending plurality of rows correspond to the aperture first and second margins and the base plurality of rows correspond to the first and second margins remaining after the aperture first and second margins. Wherein the descending plurality of rows each decrease by at least a stitch from the base plurality of rows and the ascending plurality of rows each increase by at least a stitch from the descending plurality of rows, wherein the aperture first and second margins form a smooth continuous transition from the exterior surface to the interior surface while having no reduction in fabric panel stretching flexibility.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
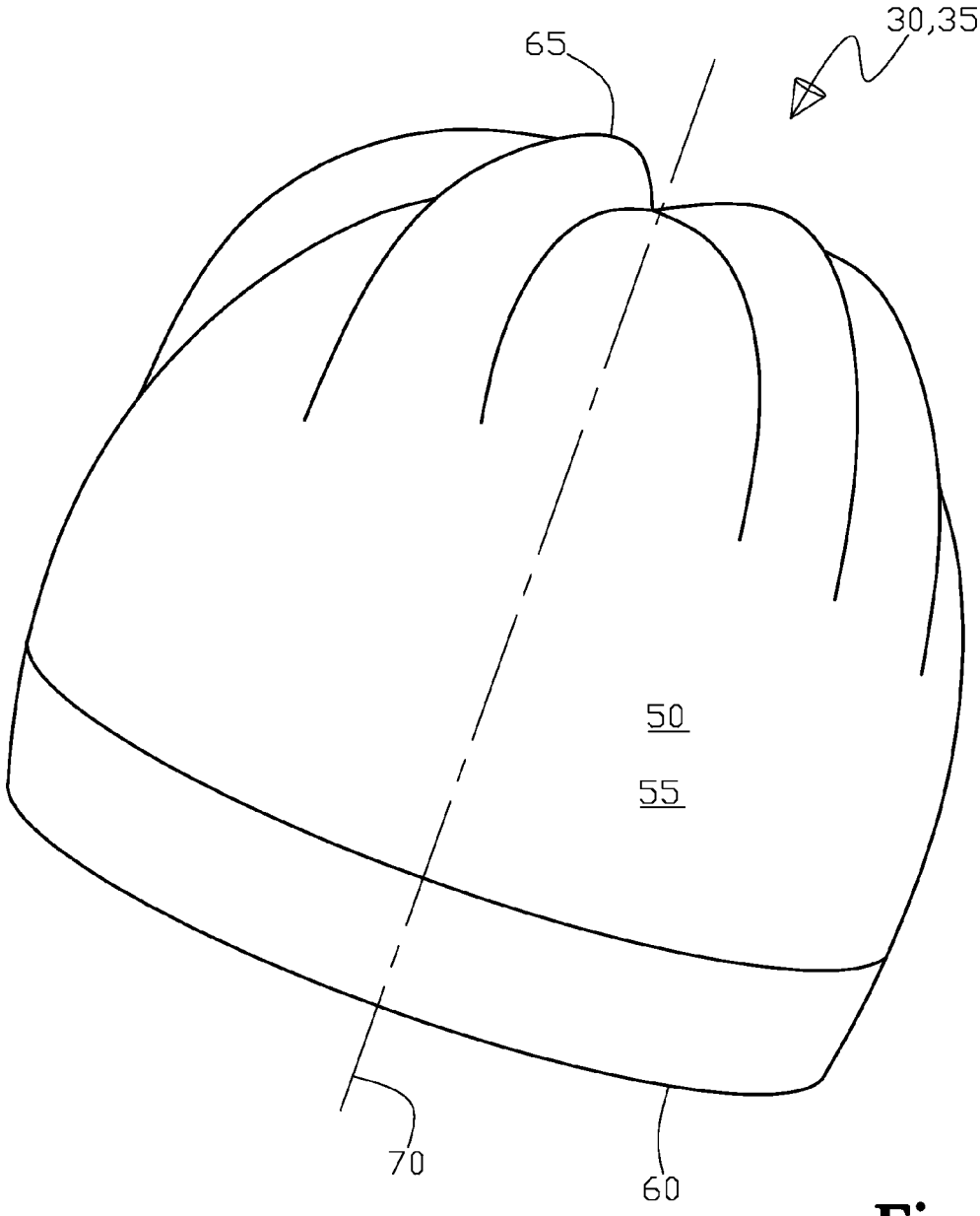
FIG. 1 shows a perspective view of the article of clothing or the embodiment of a knitted stocking cap with the open end portion, the closed end portion, and the longitudinal axis.

30 Article of clothing
35 Knitted stocking cap embodiment
40 Yarn
45 Tail length of yarn 40
50 Fabric panel
55 Knitted surrounding sidewall
60 Open end portion of knitted surrounding sidewall 55
65 Closed end portion of knitted surrounding sidewall 55
70 Longitudinal axis
75 Aperture
80 First margin of aperture 75
85 Second margin of aperture 75
86 Periphery of aperture 75
90 Base plurality of rows
95 Base stitches
100 Selected number of base stitches 95
105 End points of the base stitches 95
110 Descending plurality of rows in having a reduced number of stitches per row
115 End points of the descending stitches
120 Ascending plurality of rows in having a increased number of stitches per row
125 End points of the ascending stitches
130 First row stitching
135 End row stitching
140 Interior surface of fabric panel 30 or knitted surrounding sidewall 55
145 Exterior surface of fabric panel 30 or knitted surrounding sidewall 55
150 First margin of fabric panel 30 or knitted surrounding sidewall 55
155 Second margin of fabric panel 30 or knitted surrounding sidewall 55
156 Smooth transition from the exterior surface 145 to the aperture periphery 86 to the interior surface 140
160 Stretching flexibility of fabric panel 30 or knitted surrounding sidewall 55
165 Stitch
170 Manual knitting machine
175 Carriage of the manual knitting machine 170
180 Knitting needles of the manual knitting machine 170
185 Tapestry needle
190 Crochet hook
195 Positioning the yarn in the knitting machine 170
200 Plurality of oppositely disposed points
205 Inserting the tapestry needle 185 and tail 45 into the first 150 and second 155 end margins at the base stitch endpoints 105
210 Plurality pronged transfer tool
215 Using the plurality pronged transfer tool 210 with a matching plurality of stitches 165 picked up from their knitting needles 180 and transferred to a matching plurality of knitting needles 180 spaced one knitting needle 180 away from the last knitting needle 180 toward the knitted surrounding sidewall 55
220 Single pronged transfer tool
225 Using the single pronged transfer tool 220 for picking up a single stitch 165 from its knitting needle 180 and transferring to a knitting needle 180 spaced at least one knitting needle 180 away from the knitted surrounding sidewall 55
230 Using the crochet hook 190 and the yarn 40 to finish off the aperture periphery 86
250 Wearer
255 Hair ponytail

DETAILED DESCRIPTION

Figure 2:
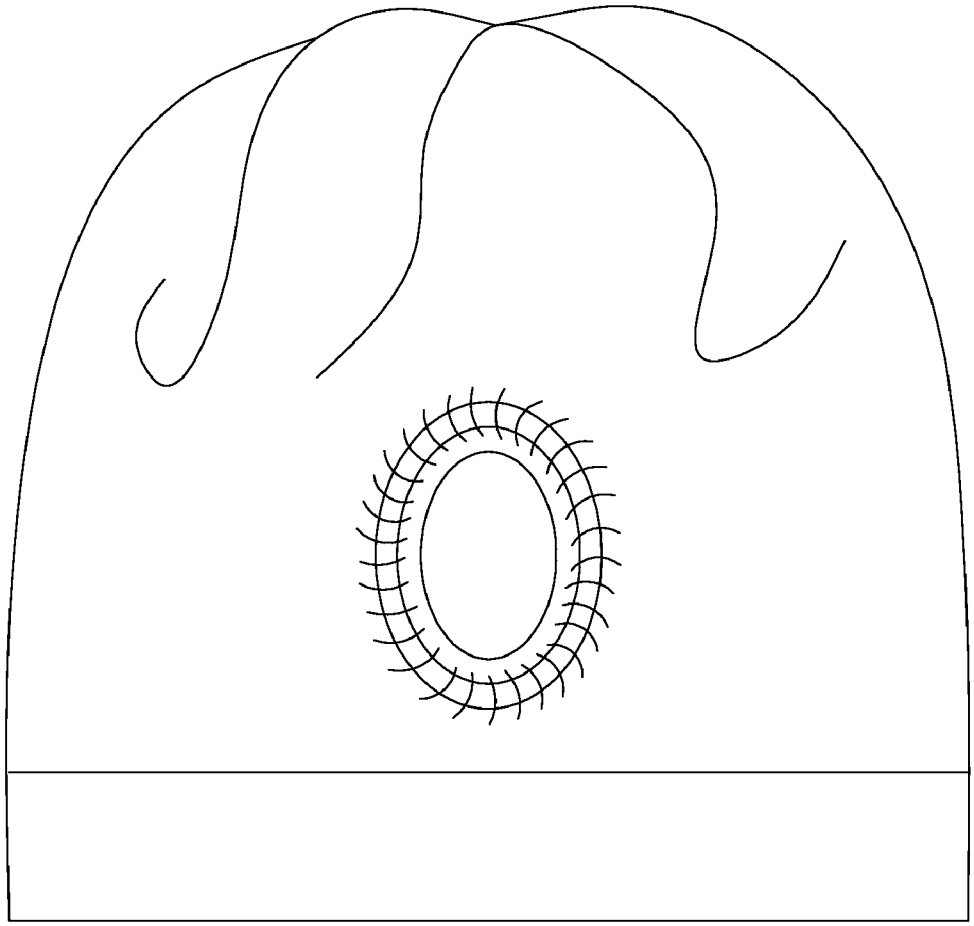
Fig.2 (Prior Art)
FIG. 2 shows a side elevation view of a typical prior art fleece cap, usually constructed of a polyester and spandex blend with a hemmed border around the aperture opening.
Figure 3:
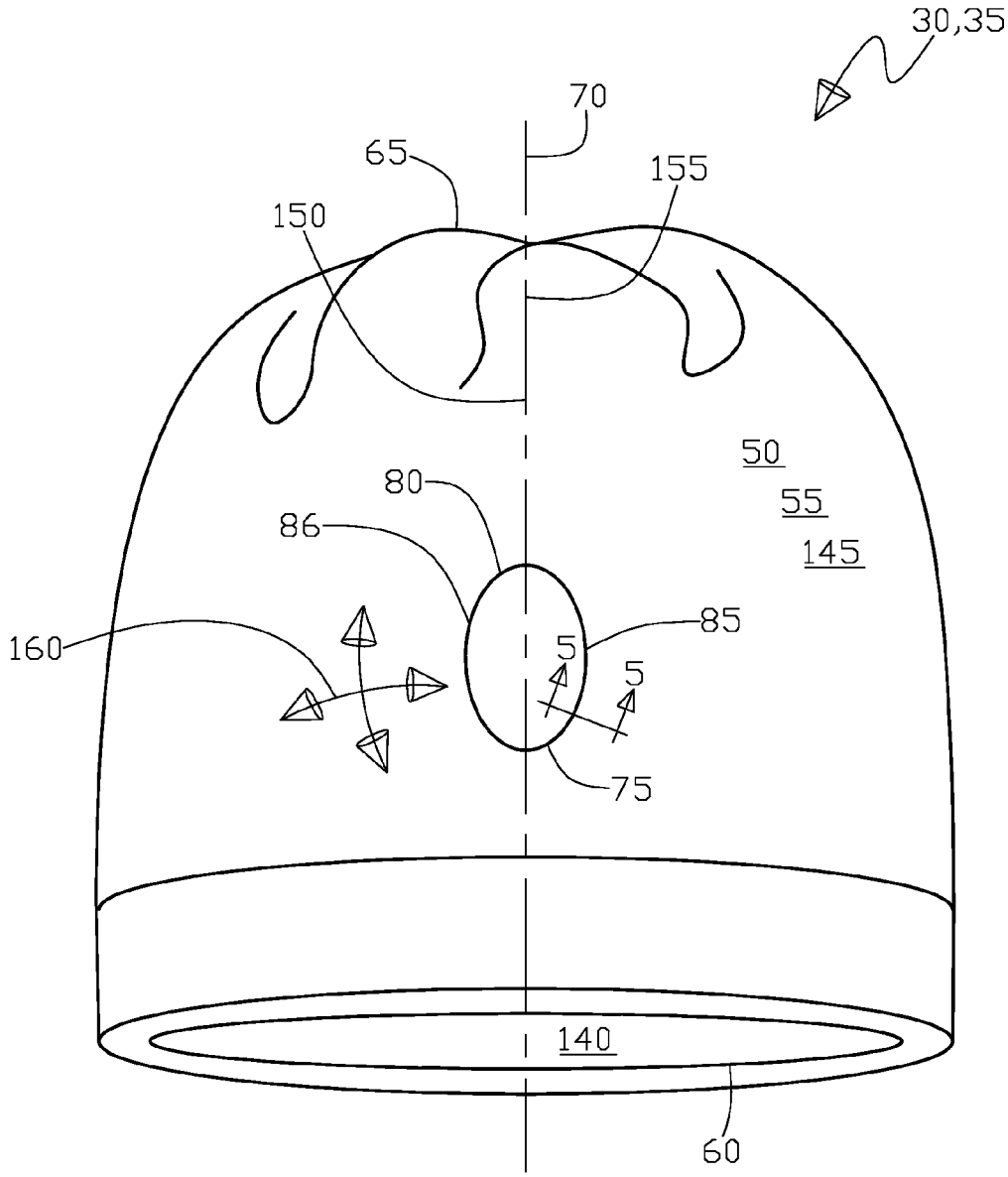
FIG. 3 shows a perspective view of the article of clothing or the embodiment of a knitted stocking cap with the open end portion, the closed end portion, the longitudinal axis, the aperture, the first and second aperture margins, the first and second panel or sidewall margins, the interior surface, and the exterior surface.
Figure 4:
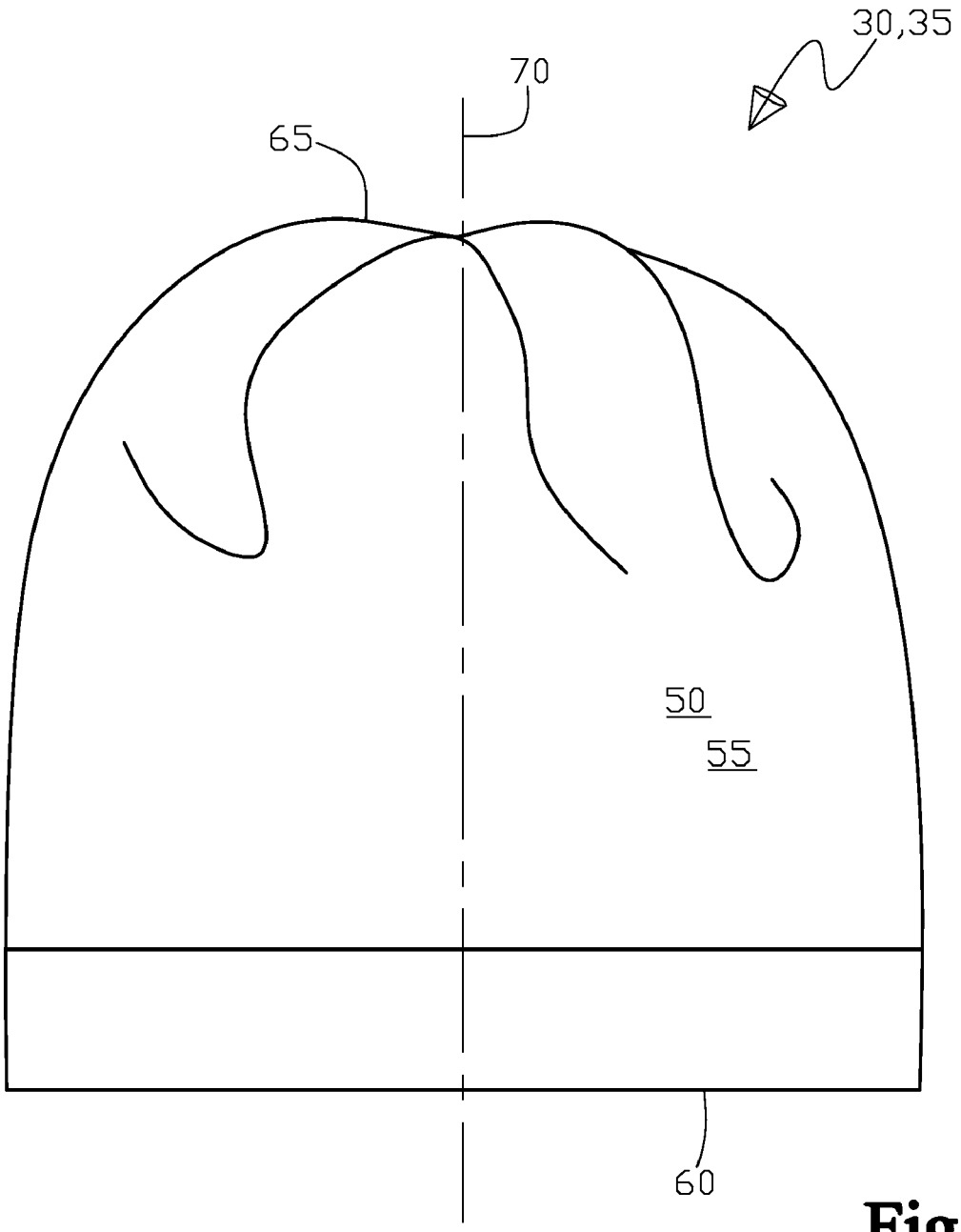
FIG. 4 shows a side elevation view of the article of clothing or the embodiment of a knitted stocking cap with the open end portion, the closed end portion, and the longitudinal axis.

With initial reference to FIG. 1 shown is a perspective view of the article of clothing 30 or the embodiment of a knitted stocking cap 35 with the open end portion 60, the closed end portion 65, and the longitudinal axis 70. Continuing, FIG. 2 shows a side elevation view of a typical prior art fleece cap, usually constructed of a polyester and spandex blend with a hemmed border around the aperture opening. Next, FIG. 3 shows a perspective view of the article of clothing 30 or the embodiment of a knitted stocking cap 35 with the open end portion 60, the closed end portion 65, the longitudinal axis 70, the aperture 75, the first 80 and second 85 aperture margins, the first 150 and second 155 fabric panel 50 or sidewall margins, the interior surface 140, and the exterior surface 145. Further, FIG. 4 shows a side elevation view of the article of clothing 30 or the embodiment of a knitted stocking cap 35 with the open end portion 60, the closed end portion 65, and the longitudinal axis 70.

Figure 5:
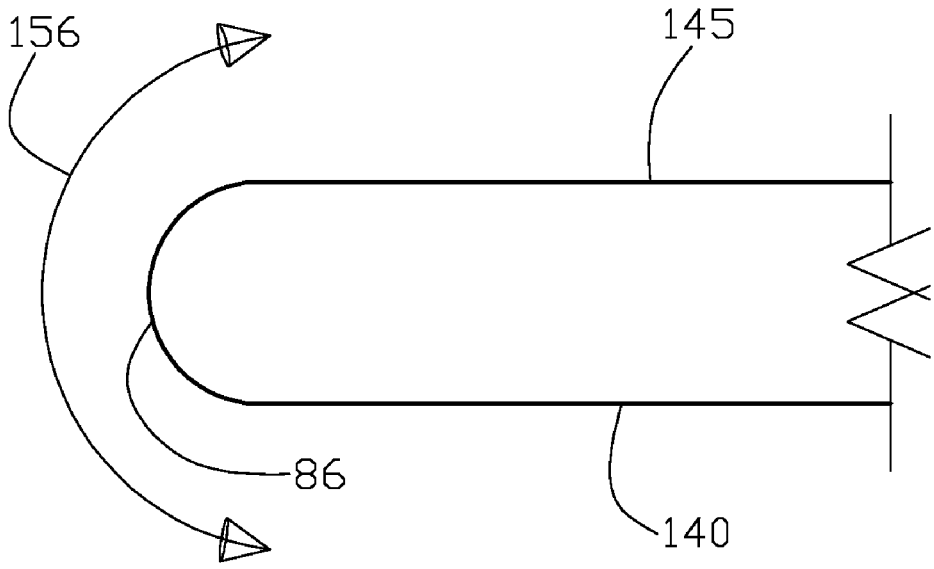
FIG. 5 is cross sectional view 5-5 from FIG. 3 that shows the smooth transition from the exterior surface to the aperture periphery and onward to the interior surface.

Next, FIG. 5 is cross sectional view 5-5 from FIG. 3 that shows the smooth transition 156 from the exterior surface 145 to the aperture periphery 86 and onward to the interior surface 140. Yet further, FIG. 6 shows a flat plan view of the article of clothing 30 or the embodiment of a knitted stocking cap 35 with the open end portion 60, the closed end portion 65, the longitudinal axis 70, the aperture 75, the first 80 and second 85 aperture margins, and the first 150 and second 155 panel 50 or sidewall 55 margins, the base plurality of rows 90, the base stitches 95, the selected number of base stitches 100, the descending plurality of rows 110, the end points of the descending stitches 115, the ascending plurality of rows 120, the end points of the ascending stitches 125, the first row stitching 130, and the end row stitching 135.

Figure 7:
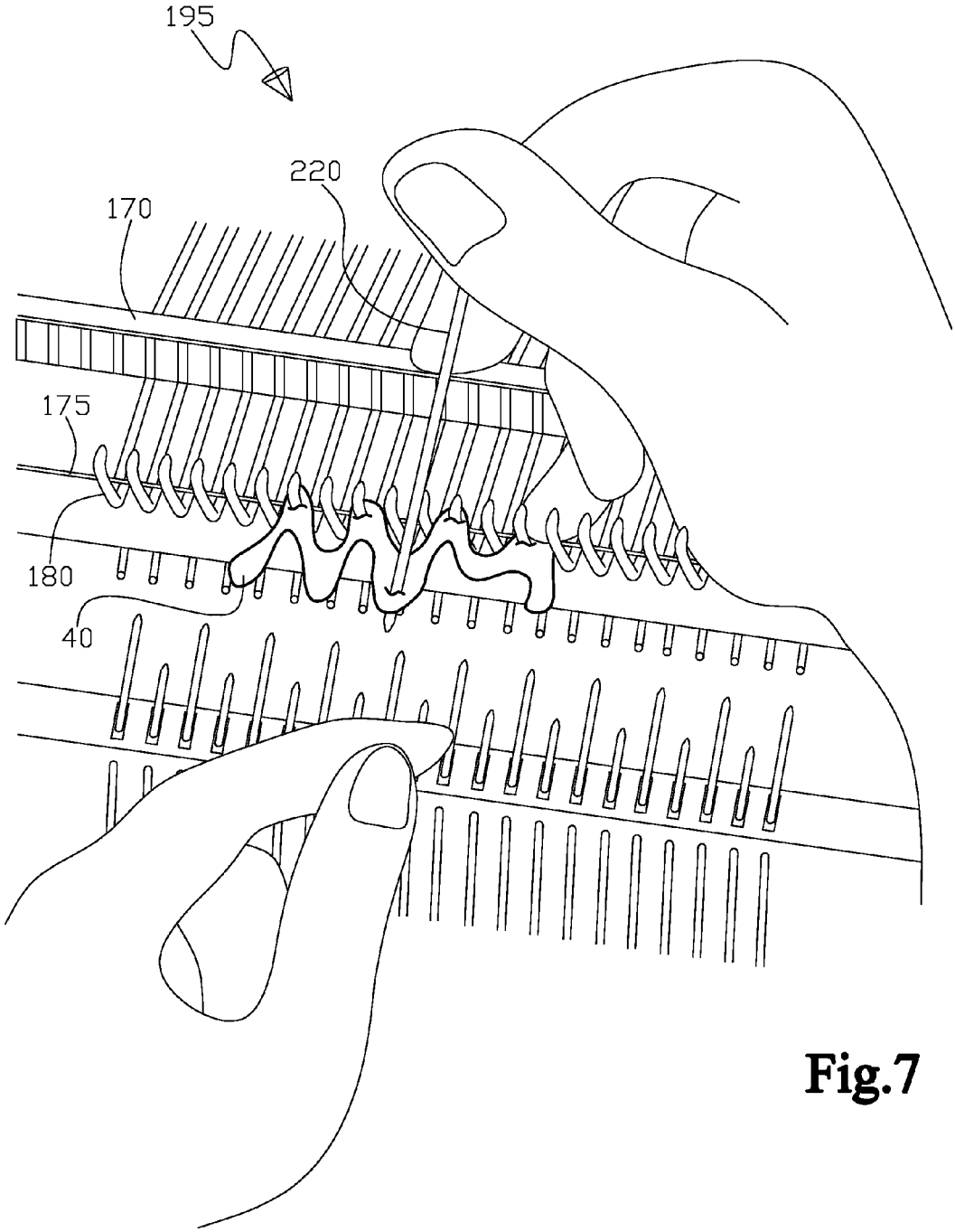
FIG. 7 shows a perspective view of the manual knitting machine with the carriage, the machine knitting needles, and where it is shown to be transferring stitches from the ribber bed to the knitter bed.
Figure 8:
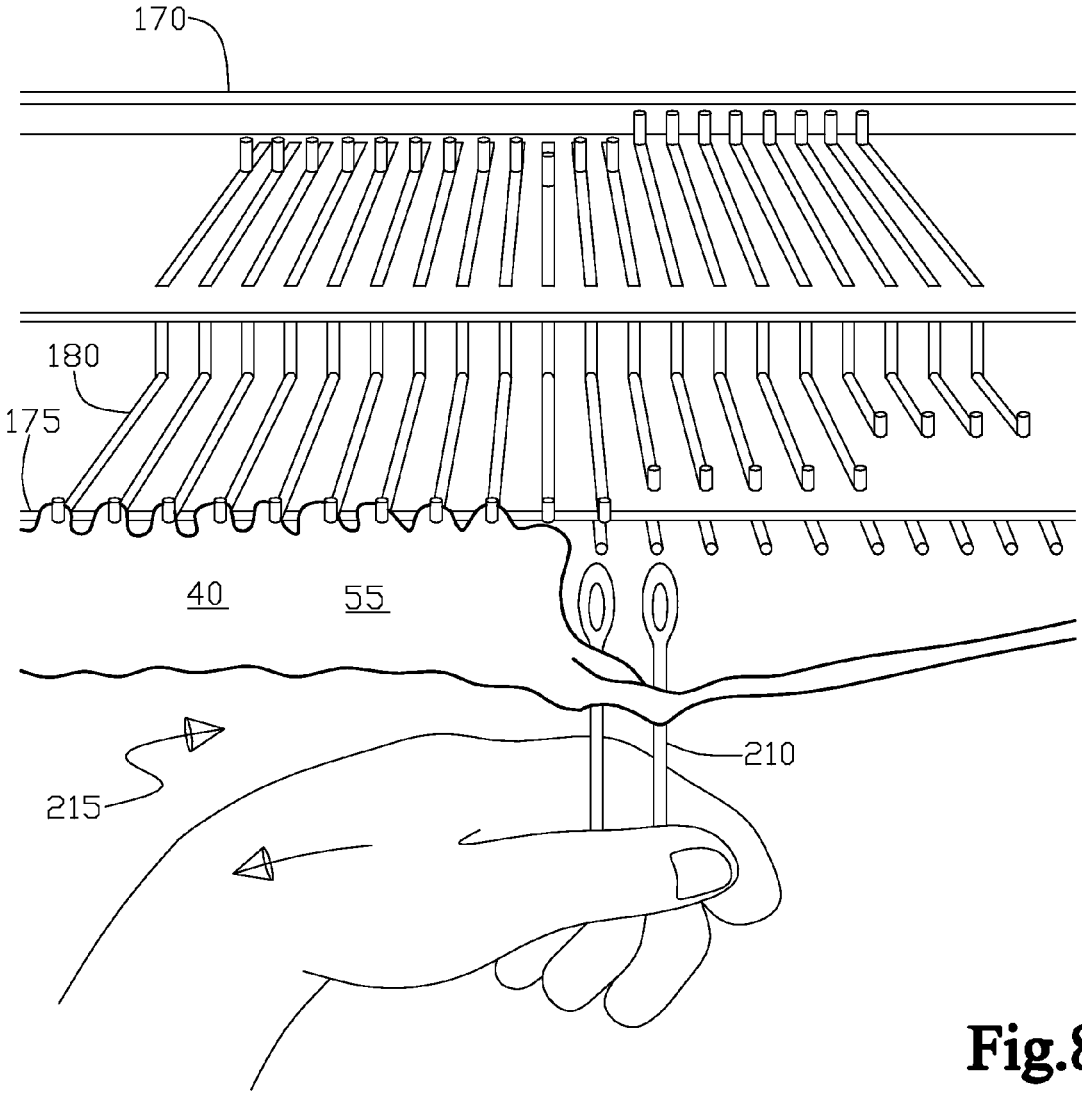
FIG. 8 shows a perspective view of the manual knitting machine with the carriage, the machine knitting needles, and where it is shown to be picking up the two most outermost stitches and moving them over one place.
Figure 9:
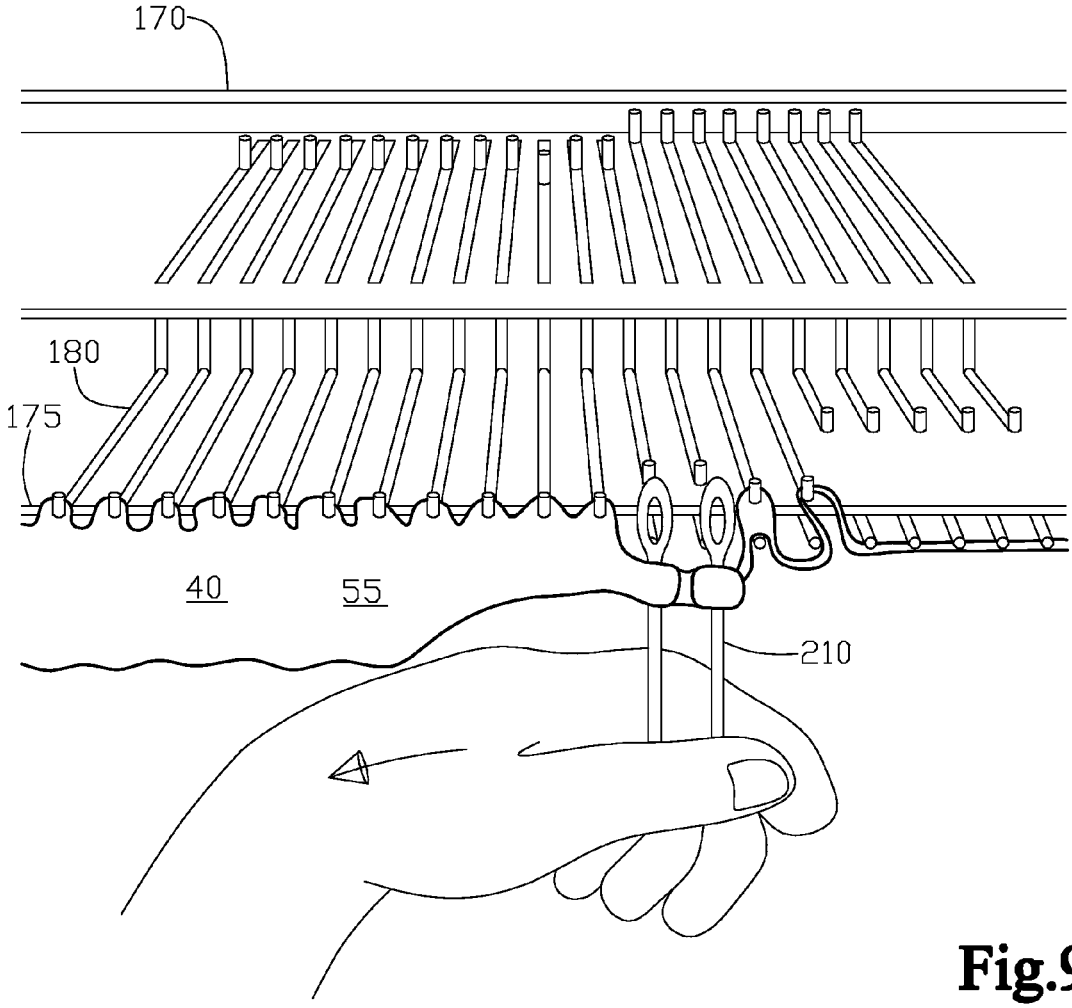
FIG. 9 shows a perspective view of the manual knitting machine with the carriage, the machine knitting needles, and where it is shown to be picking up stitches three and four to move them to the fourth and fifth place needles.
Figure 10:
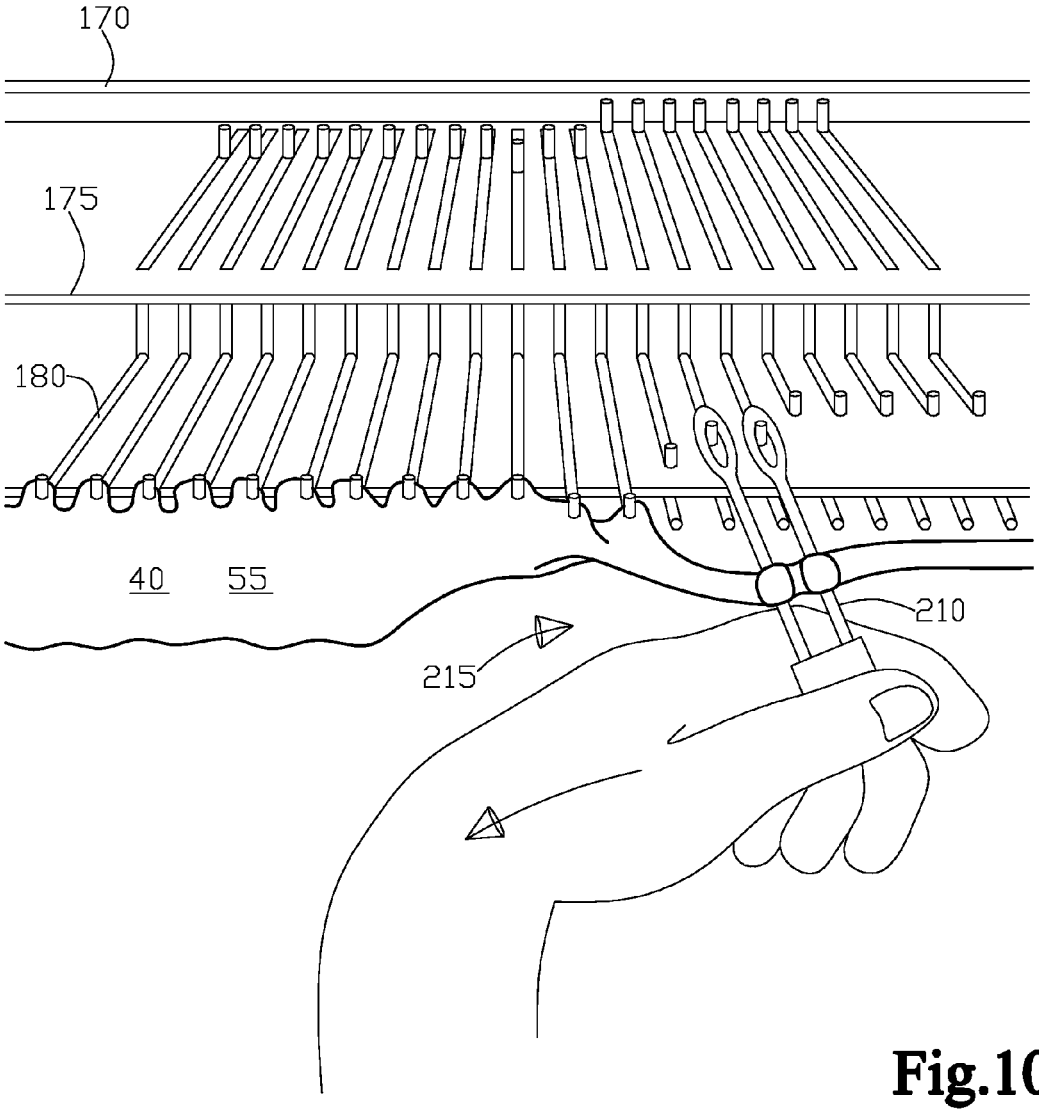
FIG. 10 shows a perspective view of the manual knitting machine with the carriage, the machine knitting needles, and where it is shown to be picking up stitches one and two to move them to the third and fourth place needles.

Continuing, FIG. 7 shows a perspective view of the manual knitting machine 170 with the carriage 175, the machine knitting needles 180, and where it is shown to be transferring stitches from the ribber bed to the knitter bed. Next, FIG. 8 shows a perspective view of the manual knitting machine 170 with the carriage 175, the machine knitting needles 180, and where it is shown to be picking up the two most outermost stitches 165 and moving them over one place. Further, FIG. 9 shows a perspective view of the manual knitting machine 170 with the carriage 175, the machine knitting needles 180, and where it is shown to be picking up stitches 165 three and four to move them to the fourth and fifth place needles 180. Moving onward, FIG. 10 shows a perspective view of the manual knitting machine 170 with the carriage 175, the machine knitting needles 180, and where it is shown to be picking up stitches 165 one and two to move them to the third and fourth place needles 180.

Figure 11:
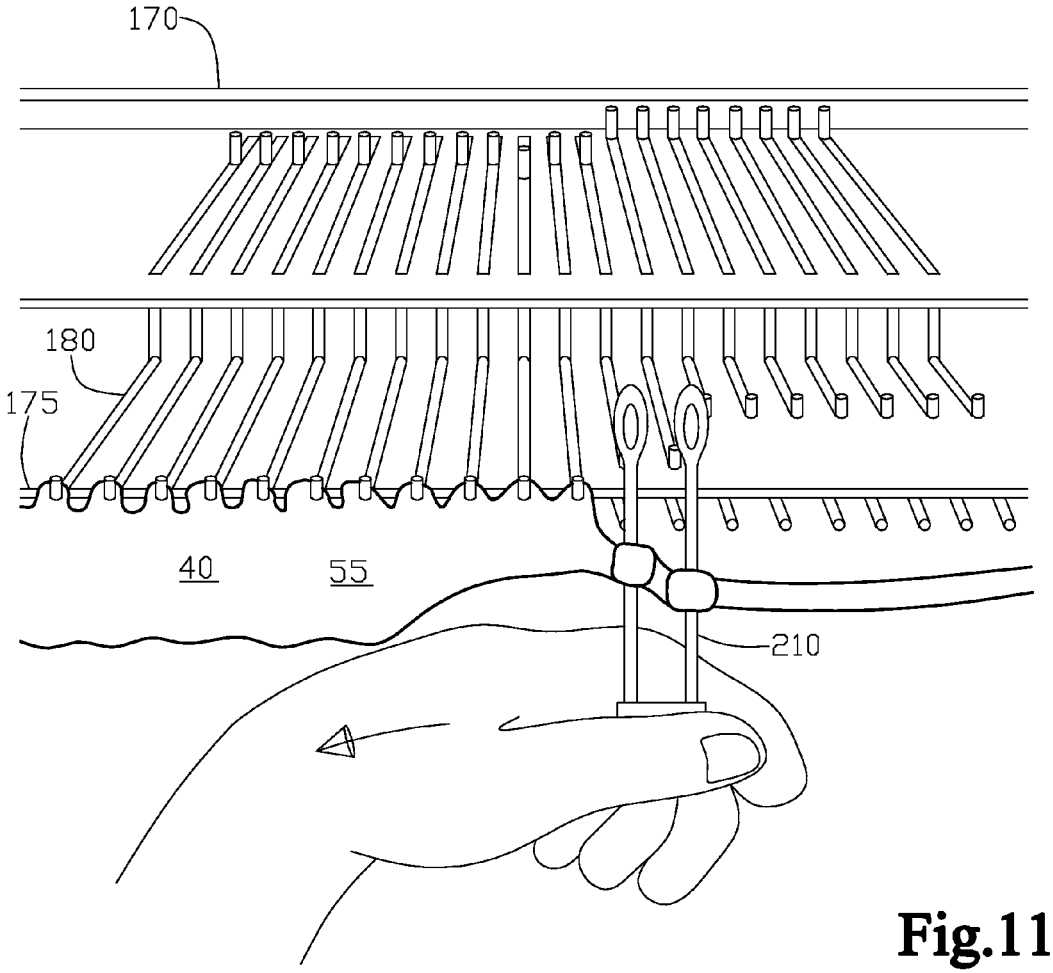
FIG. 11 shows a perspective view of the manual knitting machine with the carriage, the machine knitting needles, and where it is shown to be picking up stitches one and two to move them to the second and third place needles.
Figure 12:
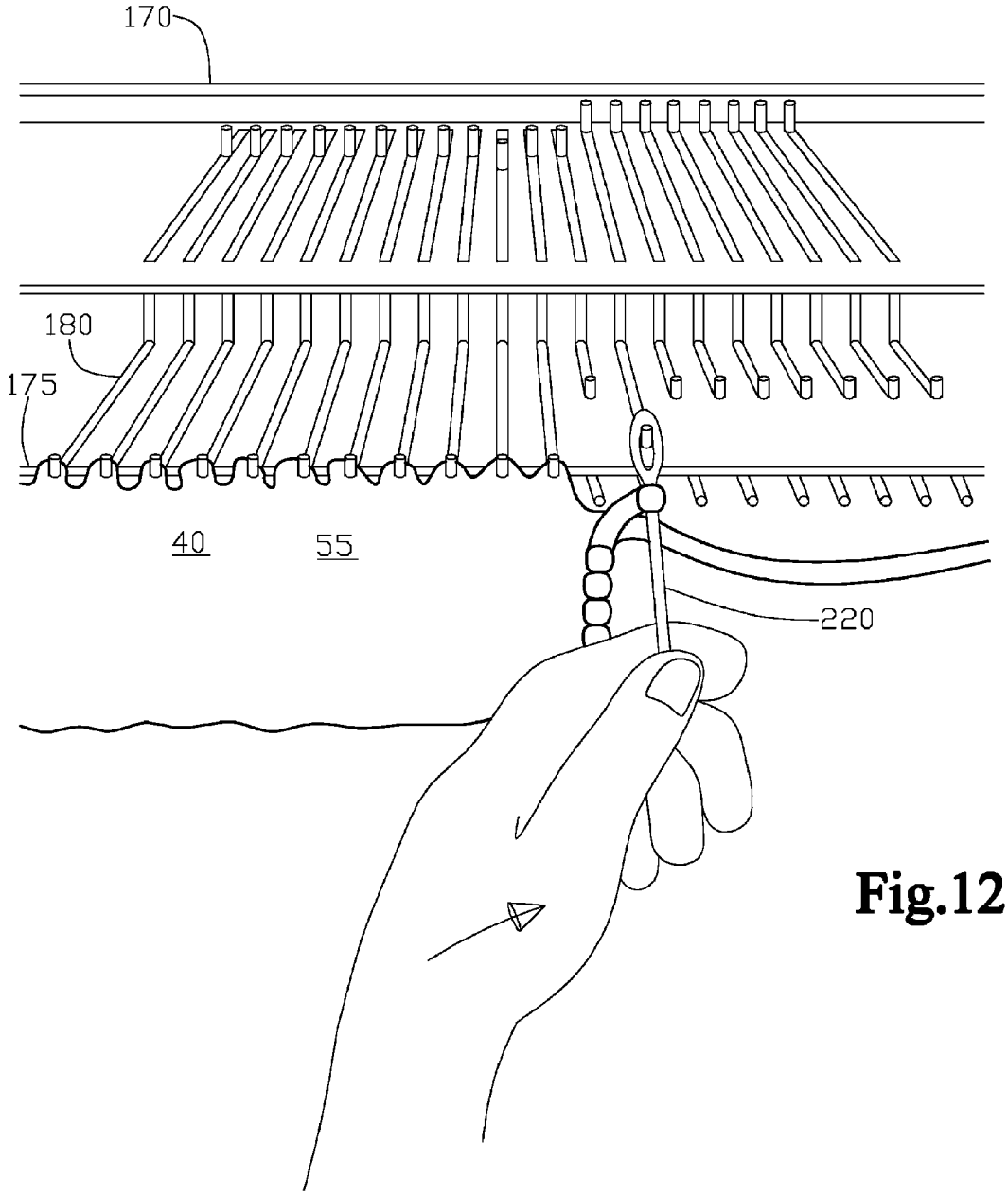
FIG. 12 shows a perspective view of the manual knitting machine with the carriage, the machine knitting needles, and where it is shown that the stitch on the end is moved to the outside by one needle.
Figure 13:
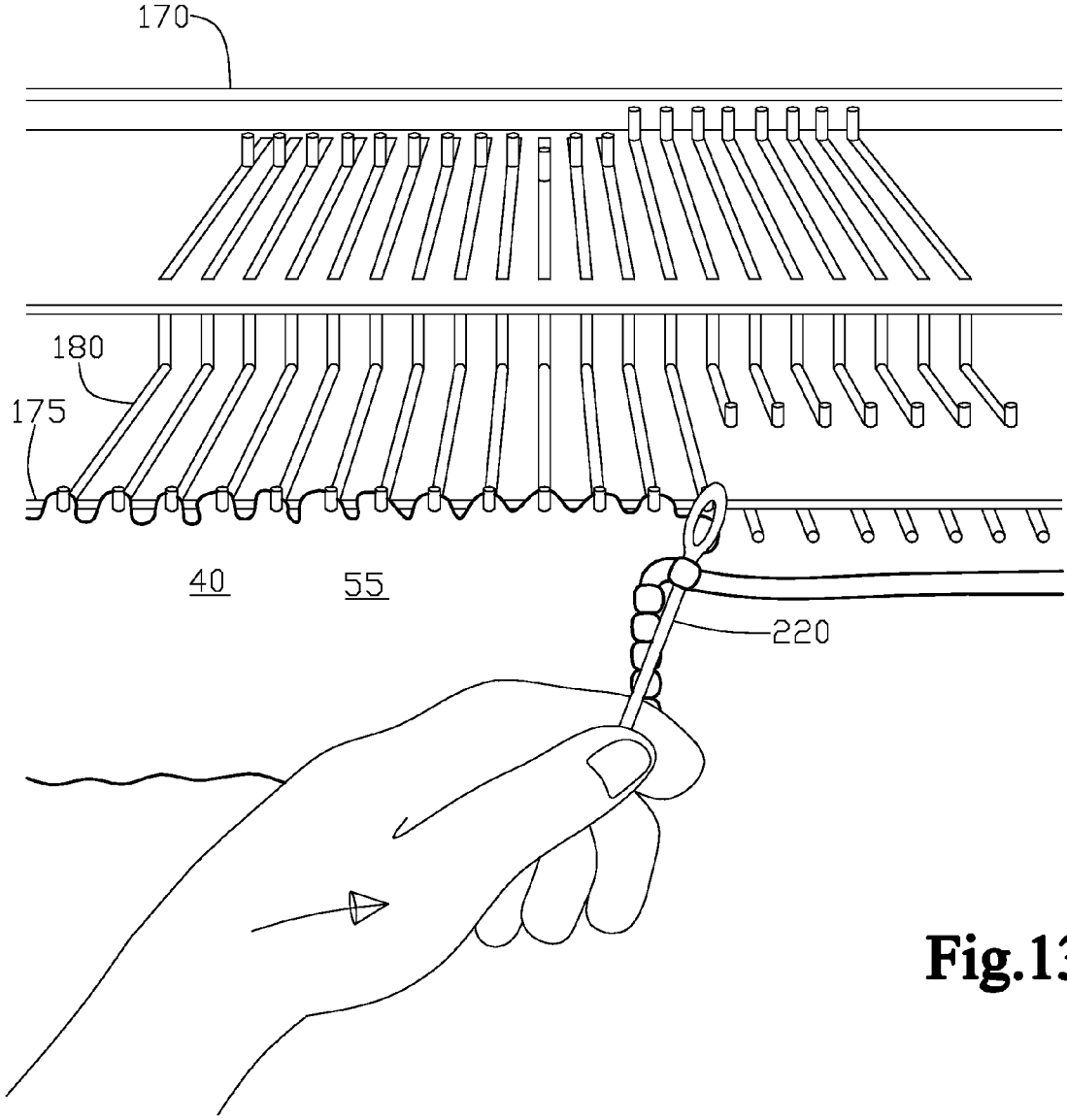
FIG. 13 shows a perspective view of the manual knitting machine with the carriage, the machine knitting needles, and where it is shown that the center loop of the outside stitches is picked up.
Figure 14:
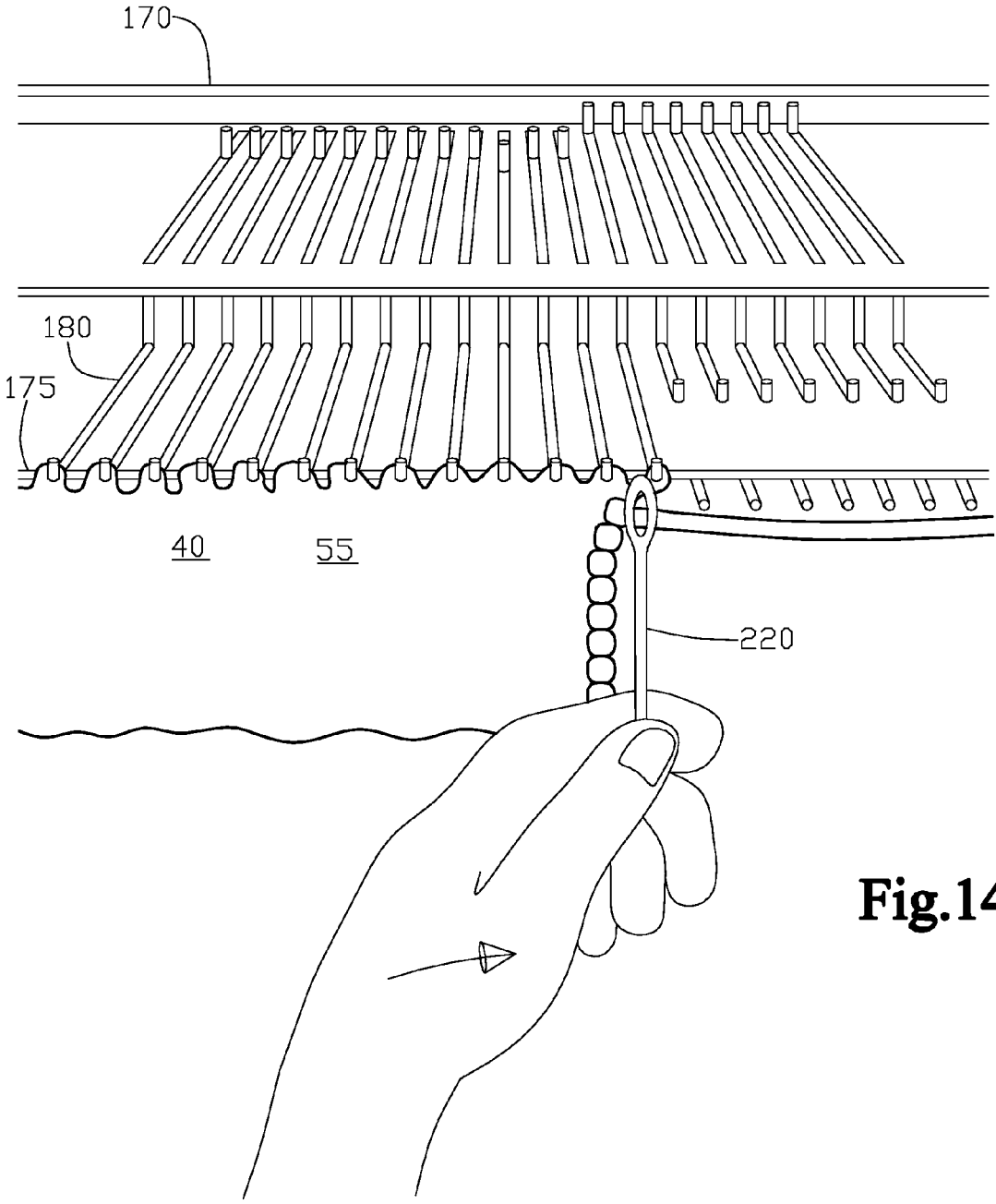
FIG. 14 shows a perspective view of the manual knitting machine with the carriage, the machine knitting needles, and where it is shown that the loop is placed on an empty needle now next to the outmost stitch.
Figure 15:
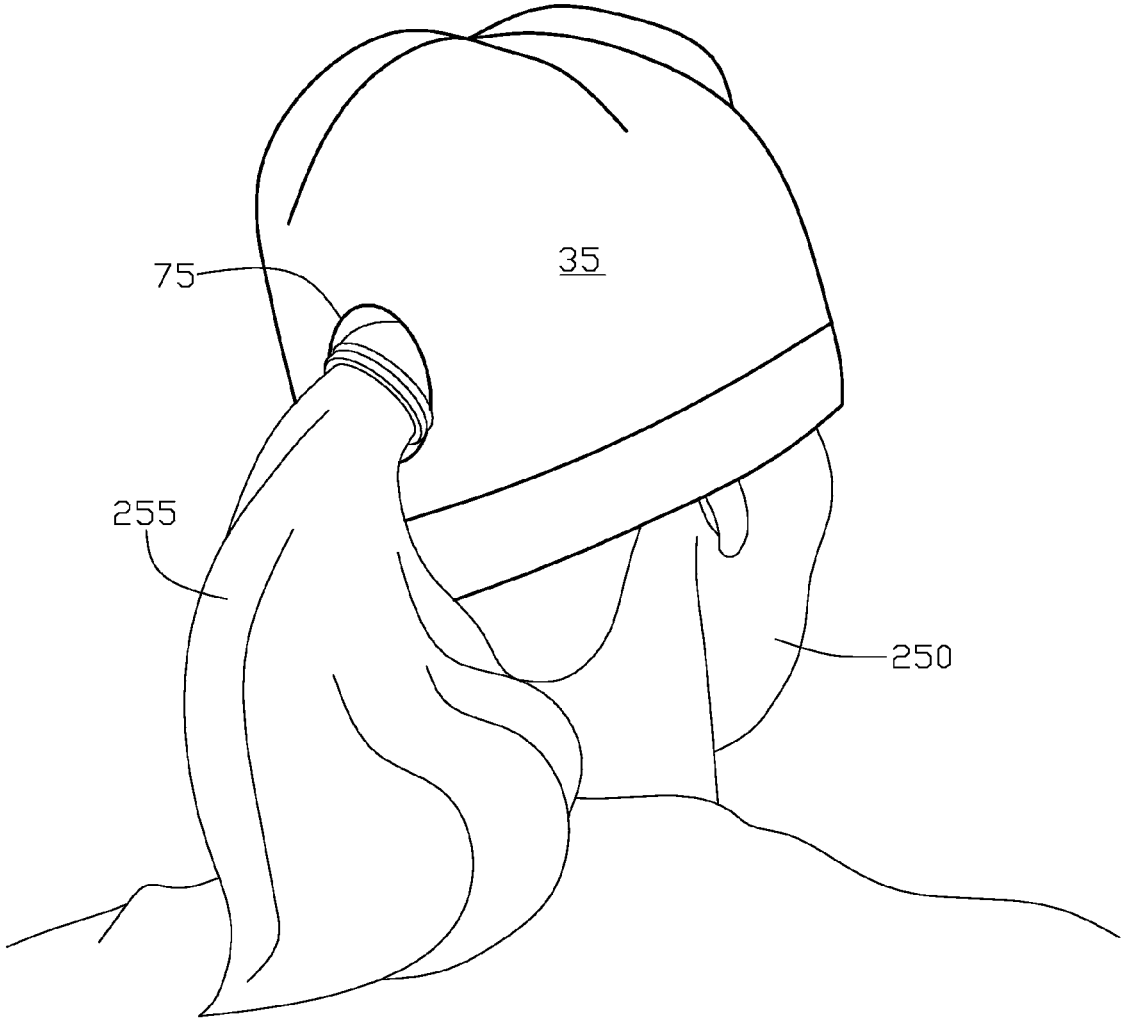
FIG. 15 shows a use perspective drawing of the knitted stocking cap with the wearer, the aperture, and the hair ponytail.

Moving ahead, FIG. 11 shows a perspective view of the manual knitting machine 170 with the carriage 175, the machine knitting needles 180, and where it is shown to be picking up stitches 165 one and two to move them to the second and third place needles 180. Next, FIG. 12 shows a perspective view of the manual knitting machine 170 with the carriage 175, the machine knitting needles 180, and where it is shown that the stitch 165 on the end is moved to the outside by one needle 180. Further, FIG. 13 shows a perspective view of the manual knitting machine 170 with the carriage 175, the machine knitting needles 180, and where it is shown that the center loop of the outside stitches 165 is picked up. Also, FIG. 14 shows a perspective view of the manual knitting machine 170 with the carriage 175, the machine knitting needles 180, and where it is shown that the loop is placed on an empty needle 180 now next to the outmost stitch 165. Next, FIG. 15 shows a use perspective drawing of the knitted stocking cap 35 with the wearer 250, the aperture 75, and the hair ponytail 255.

Figure 6:
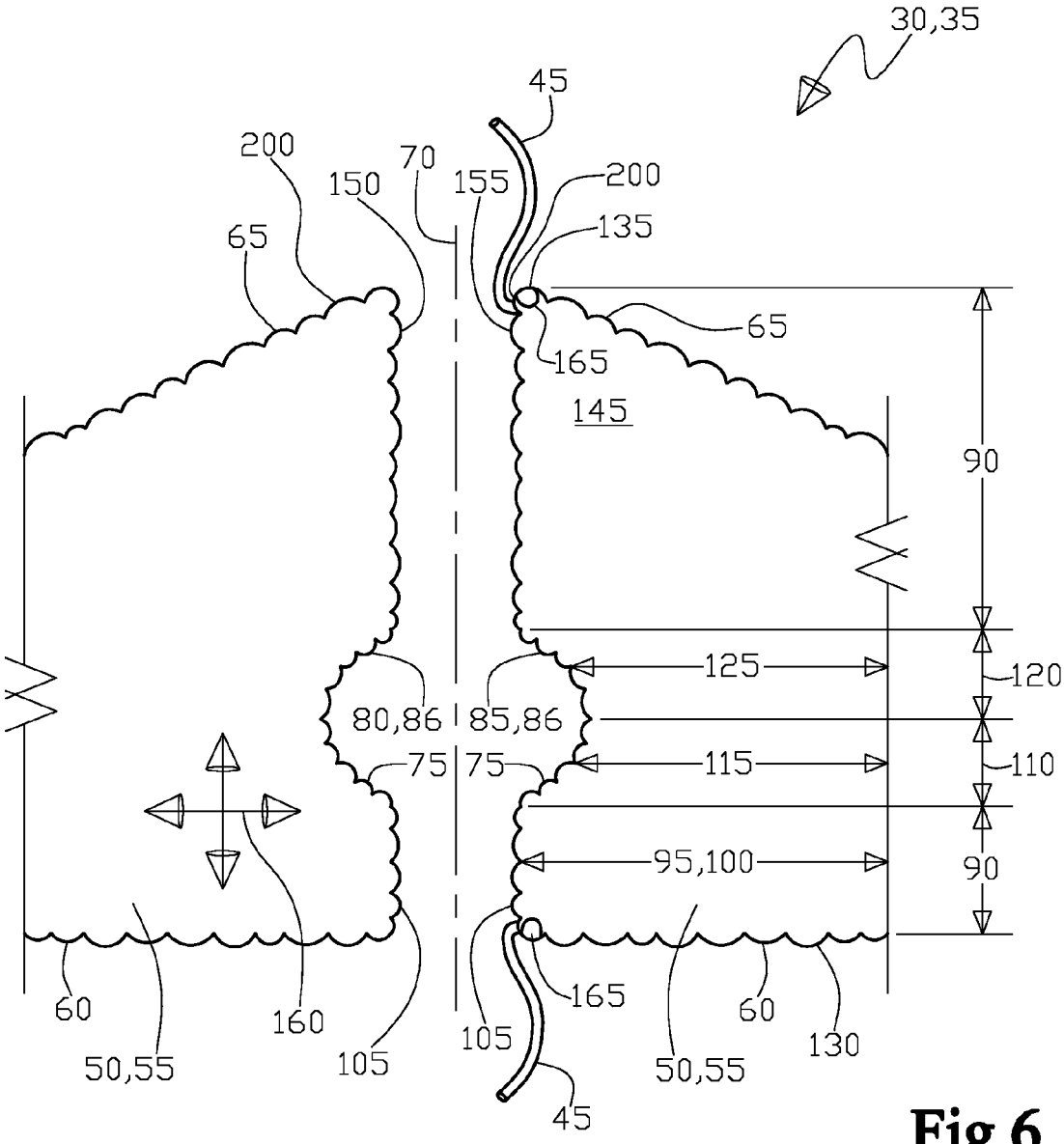
FIG. 6 shows a flat plan view of the article of clothing or the embodiment of a knitted stocking cap with the open end portion, the closed end portion, the longitudinal axis, the aperture, the first and second aperture margins, and the first and second panel or sidewall margins, the base plurality of rows, the base stitches, the selected number of base stitches, the descending plurality of rows, the end points of the descending stitches, the ascending plurality of rows, the end points of the ascending stitches, the first row stitching, and the end row stitching.

Broadly, the present invention, in referring to FIGS. 1, and 2-6, is an article of clothing 30 with an aperture 75, that includes a yarn 40 knitted into a fabric panel 50 including a base plurality of rows 90, a descending plurality of rows 110, and an ascending plurality of rows 120. The fabric panel 50 having an interior surface 140, an exterior surface 145, a first margin 150 and a second margin 155, wherein the first 150 and second 155 margins are partially adjacent to one another. Further included is an aperture 75 therethrough from the interior surface 140 to the exterior surface 145, the aperture 75 is disposed in a portion of the first 150 and second 155 margins, wherein the aperture 75 is defined by an aperture first margin 80 and an aperture second margin 85 that respectively replace a portion of the first margin 150 and the second margins 155 as best shown in FIG. 6. Wherein the aperture first margin 80 and the aperture second margin 85 combined, form an aperture periphery 86, as best shown in FIGS. 3 and 6, wherein the descending 110 and ascending 120 plurality of rows correspond to the aperture first 80 and second 85 margins and the base plurality of rows 90 correspond to the first 150 and second 155 margins remaining after the aperture first 80 and second 85 margins. Wherein the descending plurality of rows 110 each decrease by at least a stitch 165 from the base plurality of rows 90 and the ascending plurality of rows 120 each increase by at least a stitch 165 from the descending plurality of rows 110, wherein the aperture first 80 and second 85 margins form a smooth continuous transition 156 from the exterior surface 145 to the interior surface 140 while having no reduction in fabric panel 50 stretching flexibility 160, as shown in FIGS. 3 and 6.

Another embodiment of the article of clothing 30 would be a knitted stocking cap 35 with an aperture 75 that includes a yarn 40 knitted into a surrounding sidewall 55 about a longitudinal axis 70, the sidewall 55 including a base plurality of rows 90, a descending plurality of rows 110, and an ascending plurality of rows 120. The surrounding sidewall 55 having an interior surface 140, an exterior surface 145, a first margin 150, a second margin 155, an open end portion 60, and a closed end portion 65, wherein the first 150 and second 155 margins are partially adjacent to one another all as best shown in FIGS. 1, and 3-6. The preferred yarn 40 is a medium weight yarn.

Further included in the stocking cap 35, is an aperture 75 therethrough from the interior surface 140 to the exterior surface 145, the aperture 75 is disposed in a portion of the first 150 and second 155 margins in-between the open end portion 60 and the closed end portion 65. Wherein the aperture 75 is defined by an aperture first margin 80 and an aperture second margin 85 that respectively replace a portion of the first margin 150 and the second margin 155, wherein the aperture first margin 80 and the aperture second margin 85 combined form an aperture periphery 86. Wherein the descending 110 and ascending 120 plurality of rows correspond to the aperture 75 first 80 and second 85 margins and the base plurality of rows 90 correspond to the first 150 and second 155 margins remaining after the aperture first 80 and second 85 margins. Wherein the descending plurality of rows 110 each decrease by at least a stitch 165 from the base plurality of rows 90 and the ascending plurality of rows 120 each increase by at least a stitch from the descending plurality of rows 110, wherein the aperture first 80 and second 85 margin form a smooth continuous transition 156 from the exterior surface 145 to the interior surface 140 while having no reduction in the surrounding sidewall stretching flexibility 160, as shown in FIGS. 3, 5, and 6.

Method of Manufacture

Looking at all FIGS. 1 through 14 and in particular FIGS. 7 through 14, a method of manufacturing the knitted stocking cap 35 with the aperture 75 is disclosed. Starting with the step of providing a manual knitting machine 170 having a carriage 175, knitting needles 180, plus in addition a tapestry needle 185 (not shown), a crochet hook 190 (not shown), and yarn 40. Wherein, preferably the knitting machine 170 is a Silver Reed SK860 manual knitting machine with ribbing attachment or an equivalent. The knitting needles 180 are preferably size 10 or an equivalent. Also the crochet hook 190 is preferably a size 8 or an equivalent. The yarn 40 is preferably a medium weight yarn or an equivalent. The next step is in positioning the yarn 40 in the knitting machine, see FIG. 7 to start, a further step is in casting-on a selected number of base stitches 100 to start a first row 130 by moving the carriage 175, wherein a base plurality of rows 90 is started, the first row 130 starts an open end portion 60 of a knitted surrounding sidewall 55 of the knitted stocking cap 35.

A next step is in continuing to add a selected number of rows to the base plurality of rows 90 at the selected number of base stitches 100, wherein a first margin 150 and a second margin 155 are formed at the selected number of base stitches 100 endpoints 105 and continuing to form the knitted surrounding sidewall 55, as best shown in FIG. 6. Continuing, at FIGS. 8-11, a step of forming a descending plurality of rows 110 by reducing stitches 165 by at least one from the selected number of base stitches 100, wherein an aperture first margin 80 and an aperture second margin 85 of the aperture 75 are formed at the descending plurality of rows 110 stitch endpoints 115 and continuing to form the knitted surrounding sidewall 55, also see FIG. 6.

A further step as shown in FIGS. 12-14, is in forming an ascending plurality of rows 120 by increasing stitches 165 by at least one from the descending plurality of rows 110 stitch endpoints 115, wherein the aperture first margin 80 and the aperture second margin 85 of the aperture 75 are formed at the ascending plurality of rows 120 stitch endpoints 125 and continuing to form the knitted surrounding sidewall 55. The next step is in returning to the base plurality of rows 90 in re-forming the base plurality of rows 90 by continuing to form the ascending plurality of rows 120 until the selected number of base stitches 100 is equaled, wherein the first margin 150 and the second margin 155 are re-formed at the selected number of base stitches 100 endpoints 105 and continuing to form the knitted surrounding sidewall 55, as shown in FIG. 6.

Yet a further step is in continuing to add a selected number of rows to the base plurality of rows 90 at the selected number of base stitches 95, wherein the first margin 150 and the second margin 155 are re-formed at the selected number of base stitches 100 endpoints 105 and continuing to form the knitted surrounding sidewall 55, again see FIG. 6. A next step is in forming a closed end portion 65 of the knitted surrounding sidewall 55 by sequentially reducing the selected number of base stitches 100 for a selected number of rows until the reduced number of base stitches 100 equals about one-fourth of the original starting at the first row 130 selected number of base stitches 100 to form an end row 135 stitching 165 number, see FIGS. 1, 3, 4, and 6.

Next, a step of leaving a selected tail length 45 of unknitted yarn 40 extension, see FIG. 6, then threading the tail 45 into the tapestry needle 185 and then inserting the tapestry needle 185 into each stitch 165 of the end row 135, then lifting each stitch 165 from the knitting needle 180 and repeating until all the end row 135 stitches are removed from the knitting needles 180 and further a step of inserting the tapestry needle 185 and the tail 45 into the end row 135 stitching at a plurality of oppositely disposed points 200 to complete the closed end portion 65, as shown in FIGS. 1, 3, 4, and 6. Next a step of inserting 205 (not shown) the tapestry needle 185 and the tail 45 into the first 150 and second 155 end margins at the base stitch endpoints 105 to weave together the first 150 and second 155 end margins to one another, while leaving the aperture first 80 and second 85 margins or the aperture periphery 86 open to form the aperture 75, as shown in FIGS. 3 and 6.

As a refinement in the method of manufacturing a knitted stocking cap 35 with an aperture 75 for the step of forming a descending plurality of rows 110 can further comprise using 215 a plurality pronged transfer tool 210 wherein a matching plurality of stitches 165 are each picked up of off each of their respective knitting needles 180 and transferred to a matching plurality of knitting needles 180 spaced at least one knitting needle 180 away from the last knitting needle 180 used toward the knitted surrounding sidewall 55, see FIGS. 8-11.

As a further refinement in the method of manufacturing a knitted stocking cap 35 with the aperture 75 wherein the step of forming an ascending plurality of rows 120 can further comprise using 225 a single pronged transfer tool 220 wherein a single stitch 165 is picked up of off its respective knitting needle 180 and transferred to a knitting needle 180 spaced at least one knitting needle 180 away from the knitted surrounding sidewall 55, as shown in FIGS. 12-14. Further on the method of manufacturing a knitted stocking cap 35 with the aperture 75 can further comprise a step of finishing off the aperture periphery 86 of the aperture 75 by using 230 the crochet needle 190 and the yarn 40 to crochet a single chain about the aperture periphery 86 for the purpose of using the same tail 45 to weave together the first 150 and second 155 margins on each side of the aperture 75, i.e. toward the open end portion 60 and the closed end portion 65.

Stocking cap 35 embodiment particular method of manufacture;

A Ponycap is a knitting stocking cap 35 with a fixed hole or aperture 75 in the back to pull a hair ponytail 255 through. The stocking cap 35 is preferably made on a Silver Reed SK860 manual knitting machine 170 with a ribbing attachment.

Set-up: Needles 180 on the ribber and knitter 180 are moved in to position using a 1/1 needle pusher. This tool pushes forward every other needle. In total, eighty needles equating to eighty stitches 100 and 105 are moved in to "D" position to make a large size cap 35. Seventy needles equating to seventy stitches 100 and 105 are moved in to "D" position to make a small size cap 35. Swing indicator is set to H-6 and P-6. Yarn 40 is threaded in to the carriage 175 feeder and through the auto-tensioner. The yarn 40 is then secured below the needle bed to a clamp screw. The ribber carriage 175 is attached to the knitter bed to interact with the needles 180 on the ribber and knitter beds. A new row 90, 110, or 120 is knitted each time the ribber or knitted carriage 175 is moved from side to side. The ribber or knitter carriage 175 is moved manually at all times. Although the Silver Reed SK860 manual knitting machine 170 in an electronic model, the electronics of this machine 170 are not used in making the stocking cap 35.

Cast-On Rows 1-4; 130, 90, 95, and 100

Row 1: Tension dials are set at position "R" for the initial cast-on rows. Carriage 175 is moved from left to right to make the initial row 130 of the cap 35. The cast-on comb and wire in then inserted through the strand of yarn 40 and secured. Three weights are then attached to the cast-on comb to pull the cap 35 down throughout the knitting process, this is where the first margin 150 and the second margin 155 are formed at the row endpoints 105 for the plurality of base stitches 95, also forming the open end portion 60, continuing to the base plurality of rows 90 up to row 21 as described.

Row 2: Left set lever is moved to "O" position and carriage 175 is moved from right to left.

Row 3: Knitter cam lever is moved to "S" position and carriage 175 is moved from left to right.

Row 4: Knitter cam lever is moved back to "O" position and carriage 175 moved from right to left. This completes the cast-on process.

Ribbing Rows 5-15; 90, 95, and 100

Rows 5-15: Left set lever is moved to "1" position. Knitter and ribber tension dials are set at "5". Carriage 175 s moved back and forth during rows 5-15 to create a knit 1, purl 1, ribbing pattern.

Transfer;

Using the double sided transfer tool, stitches from the ribber are transferred to the knitter bed on the open needles 180. Needles 180 on the ribber are pushed down into the neutral position and ribber attachment is disengaged from the knitter attachment. Needles 180 on the knitter bed are aligned to the "C" position. Ribber carriage 175 is removed and the knitter carriage 175 is attached to the knitter bed. Tension dial on the knitter is set to "10" for the remainder of making the stocking cap 35. See FIG. 7 for transferring stitches 95 and 165 from the ribber bed to the knitter bed. Although note that ribbing is optional as the form the cast-on first row stitching 130 onward, the stitching could utilize the knitter carriage 175 only.

Rows 16-20; 90, 95, and 100

Rows 16-20: The knitter carriage 175 is moved back and forth to create these rows.

Rows 21-28; 110 and 115

Row 21: This is the first row to begin the decrease of stitches per row or the descending plurality of rows 110 in number of stitches to start forming the aperture 75 or the aperture first margin 80 and the aperture second margin 85 in the stocking cap 35. A special method of decreasing is used to create a smooth decreased edge 156 in going from the exterior surface 145 to the aperture periphery 86 to the interior surface 140, see FIG. 5. Using 215 the two pronged transfer tool 210, the two stitches at the right end of the bed are picked up and transferred to the second and third needles 180 from the end of the stocking cap 35 or the aperture first margin 80 of the panel 50 or surrounding sidewall 55, see FIG. 8. The end needle 180 which has just been emptied is pushed back to the non-working position. The same steps are performed for the opposite side of the stocking cap 35, except that in using the two pronged transfer tool 210, the two stitches at the left end of the bed are picked up and transferred to the second and third needles 180 from the end of the stocking cap 35 or the aperture second margin 85 of the panel 50 or surrounding sidewall 55, again see FIG. 8. The result is that each side i.e. the first aperture margin 80 and the aperture second margin 85 are each decreased by one stitch in that particular row or for a total decrease of two stitches for the entire row. Note that it is not necessary that each subsequent row decrease in stitches relative to its prior row, as there could be a decrease in stitches for a particular row and then the next row could have the same number of stitches, and the row after that could then resume decreasing its number of stitches. Each row requires the knitter 170 carriage 175 to be moved from right to left.

Row 22: Knitter 170 carriage 175 is moved from left to right.

Row 23: Using the two pronged transfer tool 210, stitches on the third and forth needles 180 from the right side or aperture first margin 80 are picked up and moved from their positions to needles 180 fourth and fifth from the right side or aperture first margin 80. Stitches on the first and second needles 180 from the right side or aperture first margin 80 are moved to the third and fourth needles 180 from the right side or aperture first margin 80, see FIGS. 9, 10, and 11. The same step is repeated on the left side or opposite side in using the two pronged transfer tool 210, stitches on the third and forth needles 180 from the left side or aperture second margin 85 are picked up and moved from their positions to needles 180 fourth and fifth from the left side or aperture second margin 85. Stitches on the first and second needles 180 from the left side or aperture second margin 85 are moved to the third and fourth needles 180 from the left side or aperture second margin 85, see FIGS. 9, 10, and 11. Thus the two empty needles 180 on either side are pushed back into the non-working position. Resulting in again that each side i.e. the aperture first margin 80 and the aperture second margin 85 are each decreased by one stitch in that particular row or for a total decrease of two stitches for the entire row. Subsequently the knitter 170 carriage 175 is moved from right to left.

Row 24: Knitter 170 carriage 175 is moved from left to right.

Row 25: Using the two prong transfer tool 210, stitches next to and second from the right side or aperture first margin 80 are picked up and moved to the second and third needles 180 from the right side or aperture first margin 80. The same step is repeated on the left side in using the two prong transfer tool 210, stitches next to and second from the left side or aperture second margin 85 are picked up and moved to the second and third needles 180 from the left side or aperture second margin 85. The empty needles 180 on either side are pushed back into their non-working position, see FIGS. 9, 10, and 11. Resulting in again that each side i.e. the aperture first margin 80 and the aperture second margin 85 are each decreased by one stitch in that particular row or for a total decrease of two stitches for the entire row. Subsequently the knitter 170 carriage 175 is moved from right to left.

Rows 26-28: The knitter 170 carriage 175 is moved from left to right and from right to left to create new rows.

Rows 29-34; 120 and 125

Row 29: This is the first row to begin the ascending plurality of rows 120 or to increase the number of stitches per row, thus continuing to form the aperture first margin 80 and the aperture second margin 85 and to eventually return to the selected number of stitches 100 in the base rows 90, wherein the first margin 150 and second margin 155 are re-formed. The stitch increases are made using a special method of increasing to have a smooth edge or transition 156 in going from the exterior surface 145 to the aperture periphery 86 to the interior surface 140, see FIG. 5. Using 225 the single prong transfer tool 220, the stitch of the far right side or aperture first margin 80 is picked up and moved to the needle 180 one space to the right or toward the aperture first margin 80. This needle 180 is pushed forward into the working position. The one prong transfer tool 220 is slipped into the loop of the previously moved stitch and carried up to the second needle 180 from the right side or aperture first margin 80, see FIGS. 12-14. This creates a new stitch. The same is repeated of the left side or aperture second margin 85 in using the single prong transfer tool 220, the stitch of the far left side or aperture second margin 85 is picked up and moved to the needle 180 one space to the left or toward the aperture second margin 85. This needle 180 is pushed forward into the working position. The one prong transfer tool 220 is slipped into the loop of the previously moved stitch and carried up to the second needle 180 from the left side or aperture second margin 85, see FIGS. 12-14. This again creates a new stitch. Thus the row is increased by one stitch for each side i.e. the aperture first 80 and the aperture second margin 85 for a total of two stitches of increase for the row. The knitter 170 carriage 175 is moved from right to left.

Note that it is not necessary that each subsequent row increase in stitches relative to its prior row, as there could be a increase in stitches for a particular row and then the next row could have the same number of stitches, and the row after that could then resume increasing its number of stitches.

Row 30: Knitter 170 carriage 175 is moved from left to right creating a new row.

Row 31: Using the one pronged transfer tool 220, the stitch of the far right side or aperture first margin 80 is picked up and moved to the needle 180 one space to the right or toward the aperture first margin 80. This needle is pushed forward into the working position. The one prong transfer tool 220 is slipped into the loop of the previously moved stitch and carried up to the second needle 180 from the right or the aperture first margin 80. This again creates a new stitch. The same is repeated on the left side or aperture second margin 85 in using the one pronged transfer tool 220, the stitch of the far left side or aperture second margin 85 is picked up and moved to the needle 180 one space to the left or toward the aperture second margin 85. This needle is pushed forward into the working position. The one prong transfer tool 220 is slipped into the loop of the previously moved stitch and carried up to the second needle 180 from the left or the aperture second margin 85. This again creates a new stitch. Thus this row has increased by two stitches. The knitter 170 carriage 175 is moved from right to left.

Row 32: Knitter 170 carriage 175 is moved from left to right creating a new row.

Row 33: Using the one prong transfer tool 220, the stitch on the far right side or aperture first margin 80 is picked up and moved to the needle 180 one space to the right or toward aperture first margin 80. This needle 180 is pushed forward into the working position. The one prong transfer tool 220 is slipped into the loop of the previously moved stitch and carried up to the second needle 180 from the right or aperture first margin 80. This creates a new stitch. Repeating for the left side or aperture second margin 85 in using the one prong transfer tool 220, the stitch on the far left side or aperture second margin 85 is picked up and moved to the needle 180 one space to the left or toward aperture second margin 85. This needle 180 is pushed forward into the working position.

The one prong transfer tool 220 is slipped into the loop of the previously moved stitch and carried up to the second needle 180 from the left or aperture second margin 85. This creates a new stitch. Thus in total two new added stitches are created for this row. The knitter 170 carriage 175 is moved from right to left.

Row 34: Knitter 170 carriage 175 is moved from left to right creating a new row.

Row 35: Using the one prong transfer tool 220, the stitch on the far right side or toward the aperture first margin 80 is picked up and moved to the needle 180 one space to the right toward the aperture first margin 80. This needle 180 is pushed forward into working position. The one prong transfer tool 220 is slipped into the loop of the previously moved stitch and carried up to the second needle 180 from the right or the aperture first margin 80. This creates a new stitch. The same is repeated for the left side in using the one prong transfer tool 220, the stitch on the far left side or toward the aperture second margin 85 is picked up and moved to the needle 180 one space to the left toward the aperture second margin 85. This needle 180 is pushed forward into working position. The one prong transfer tool 220 is slipped into the loop of the previously moved stitch and carried up to the second needle 180 from the left or the aperture second margin 85. This creates a new stitch or an additional stitch per side. Again see FIGS. 12-14. The knitter 170 carriage 175 is moved from right to left. At this point this is the final ascending stitch with this row coming back to the original stitch width or the selected number of base stitches 100 and from this point onward returning to the base stitches 95 and the base plurality if rows 90, wherein the stitch endpoints 105 re-form the first 150 and second 155 margins.

Rows 36-46; 90, 95, and 100

Rows 36-46: Knitter 170 carriage 175 is moved back and forth to create the top portion of the stocking cap 35.

Rows 47-51; 65

Row 47: This starts the closed end portion 65 of the knitted surrounding sidewall 55 or what could be called the dome portion of the stocking cap 35, see FIGS. 1, 3, and 4. Using the one prong transfer tool 22, every other stitch is picked up and moved one needle 180 to the left or toward the second margin 155. This decreases the number of stitches from eighty 100 to forty, thus bringing the dome shape or closed end portion 65 together. The empty needles 180 back into the non working position using the 1/1 needle pusher. Knitter 170 carriage 175 is moved from left to right to create a row.

Row 48: Knitter 170 carriage 175 is moved from left to right creating a new row.

Row 49: Using the one pronged transfer tool 220, every other stitch is picked up and moved one needle 180 to the left or toward the second margin 155. This decreases the number or stitches from forty to twenty, thus further bringing the dome shape or closed end portion 65 together. The empty needles 180 are pushed back into the non-working position using the 1/1 needle pusher. Knitter 170 carriage 175 is moved from right to left to create a row.

Rows 50-51: Knitter 170 carriage 175 is moved back and forth to create the last two rows 135 of the cap.

Removing the stocking cap 35 from the knitting machine 170.

Yarn 40 is removed from the knitter 170 carriage 175 and a tail 45 of about twelve inches is cut. The end of the tail is threaded into a tapestry needle 185. The needles 180 currently holding stitches are pushed forward one at a time starting from the right side or first margin 150 of the knitting machine 170 bed. The tapestry needle 185 is inserted behind each stitch and lifted from the knitting needle 180. The knitting needle 180 is pushed back into the non-working position. This is repeated for the remaining 19 stitches, i.e. starting from the twenty stitches left in row 49. At this point the stocking cap 35 or more specifically the knitted surrounding sidewall 55 is completely removed from the knitting machine 170.

Finishing the stocking cap 35

The tapestry needle 185 and yarn 40 tail 45 are inserted into the opposite side 200 of the top or final last end row 135 of the stocking cap 35 or surrounding sidewall 55, and pulled tight to bind the stitches of the end row 135 together forming the closed end portion 65, as best shown in FIGS. 1, 3, and 4. The tapestry needle 185 is then inserted into the open loop of the edge end row 135 on the opposite side 200. This is repeated until the top of the opening is closed 65 by bringing what appears to be two half circles on either edge end row 135 of the stocking cap 35. The tapestry needle 185 is then inserted down through down through the right side or first margin 150 moving toward the aperture first margin 80, i.e. going from the closed end portion 65 to the open end portion 60 by inserting the tapestry needle 185 alternately into the open loops of the second margin 155 and then the first margin 150 forming a seam until the aperture first 80 and second 85 margins are reached, wherein the tapestry needle 185 and yarn 40 tail 45 are inserted into either the aperture first margin 80 or the aperture second margin 85, so as to leave the aperture periphery 86 intact, as shown in FIG. 3. Once the tapestry needle 185 and yarn 40 tail 45 are past the aperture first 80 and second 85 margins, in going from the closed end portion 65 to the open end portion 60 then the tapestry needle 185 and yarn 40 tail 45 are inserted into the first 150 and second 155 margins again forming a seam as before going to the open end portion 60. At this point the yarn 40 tail 45 is inserted back and forth into the newly created seam adjacent to the interior surface 140 to secure the tail 45 and the seam. Note that the same is done for the other tail 45 that was left from the first row stitching 130 to secure the tail 45. Thus knots are not required to bind off the tails 45.

Conclusion

Accordingly, the present invention of a article of clothing with aperture has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

The invention claimed is:

1. An article of clothing with aperture, comprising:

(a) a yarn knitted into a fabric panel including a base plurality of rows of knit stitches, a descending plurality of rows of knit stitches, and an ascending plurality of rows of knit stitches, said fabric panel having an interior surface, an exterior surface, a first margin and a second margin, wherein said first and second margins are partially adjacent to one another; and (b) an aperture therethrough from said interior surface to said exterior surface, said aperture is disposed in a portion of said first and second margins, wherein said aperture is defined by an aperture first margin and an aperture second margin that respectively replace a portion of said first margin and said second margin, wherein said aperture first margin and said aperture second margin combined form an aperture periphery, wherein said descending and ascending plurality of rows of knit stitches correspond to said aperture first and second margins and said base plurality of rows of knit stitches correspond to said first and second margins remaining after said aperture first and second margins, wherein said descending plurality of rows of knit stitches each decrease by at least a stitch from said base plurality of rows of knit stitches and said ascending plurality of rows of knit stitches each increase by at least a stitch from said descending plurality of rows of knit stitches, wherein said aperture first and second margins form a smooth continuous transition from said exterior surface to said interior surface while having no reduction in fabric panel stretching flexibility.

2. A knitted stocking cap with aperture, comprising:

(a) a yarn knitted into a surrounding sidewall about a longitudinal axis, said sidewall including a base plurality of rows of knit stitches, a descending plurality of rows of knit stitches, and an ascending plurality of rows of knit stitches, said surrounding sidewall having an interior surface, an exterior surface, a first margin, a second margin, an open end portion, and a closed end portion, wherein said first and second margins are partially adjacent to one another; and (b) an aperture therethrough from said interior surface to said exterior surface, said aperture is disposed in a portion of said first and second margins in-between said open end portion and said closed end portion, wherein said aperture is defined by an aperture first margin and an aperture second margin that respectively replace a portion of said first margin and said second margin, wherein said aperture first margin and said aperture second margin combined form an aperture periphery, wherein said descending and ascending plurality of rows of knit stitches correspond to said aperture first and second margins and said base plurality of rows of knit stitches correspond to said first and second margins remaining after said aperture first and second margins, wherein said descending plurality of rows of knit stitches each decrease by at least a stitch from said base plurality of rows of knit stitches and said ascending plurality of rows of knit stitches each increase by at least a stitch from said descending plurality of rows of knit stitches, wherein said aperture first and second margins form a smooth continuous transition from said exterior surface to said interior surface while having no reduction in said surrounding sidewall stretching flexibility.

3. A method of manufacturing a knitted stocking cap with an aperture, comprising the steps of:

(a) providing a manual knitting machine having a carriage, knitting needles, a tapestry needle, a crochet hook, and yarn;

(b) positioning said yarn in the knitting machine;

(c) casting-on a selected number of base knit stitches to start a first row by moving the carriage, wherein a base plurality of rows of knit stitches is started, said first row of knit stitches starts an open end portion of a knitted surrounding sidewall of said knitted stocking cap;

(d) continuing to add a selected number of rows of knit stitches to said base plurality of rows of knit stitches at said selected number of base knit stitches, wherein a first margin and a second margin are formed at said selected number of base knit stitches endpoints and continuing to form said knitted surrounding sidewall;

(e) forming a descending plurality of rows of knit stitches by reducing stitches by at least one from said selected number of base knit stitches, wherein an aperture first margin and an aperture second margin of said aperture are formed at descending knit stitches end points of said descending plurality of rows knit stitch endpoints and continuing to form said knitted surrounding sidewall;

(f) forming an ascending plurality of rows of knit stitches by increasing stitches by at least one from said descending plurality of rows knit stitch endpoints, wherein an aperture first margin and an aperture second margin of said aperture are formed at ascending knit stitch endpoints of said ascending plurality of rows knit stitch endpoints and continuing to form said knitted surrounding sidewall;

(g) re-forming said base plurality of rows of knit stitches by continuing to form said ascending plurality of rows of knit stitches until said selected number of base knit stitches is equaled, wherein said first margin and said second margin are re-formed at said selected number of base knit stitches endpoints and continuing to form said knitted surrounding sidewall;

(h) continuing to add a selected number of rows of knit stitches to said base plurality of rows of knit stitches at said selected number of base knit stitches, wherein said first margin and said second margin are formed at said selected number of base knit stitches endpoints and continuing to form said knitted surrounding sidewall;

(i) forming a closed end portion of said knitted surrounding sidewall by sequentially reducing said selected number of base knit stitches for a selected number of rows of knit stitches until said reduced number of base knit stitches equals about one-fourth of said selected number of base knit stitches to form an end row knit stitching;

(j) leaving a selected tail length of un-knitted yarn extension;

(k) threading said tail into the tapestry needle and then inserting the tapestry needle into each knit stitch of said end row, then lifting each said knit stitch from the knitting needle and repeating until all said end row knit stitches are removed from the knitting needles;

(l) inserting the tapestry needle and said tail into said end row knit stitching at a plurality of oppositely disposed points to complete said closed end portion; and (m) inserting the tapestry needle and said tail into said first and second end margins at said base knit stitch endpoints to weave together said first and second end margins to one another.

4. A method of manufacturing a knitted stocking cap with an aperture according to claim 3 wherein said step of forming a descending plurality of rows of knit stitches further comprises using a plurality pronged transfer tool wherein a matching plurality of knit stitches are each picked up of off each of their respective knitting needles and transferred to a matching plurality of knitting needles spaced at least one knitting needle away from the last knitting needle used toward said knitted surrounding sidewall.

5. A method of manufacturing a knitted stocking cap with an aperture according to claim 3 wherein said step of forming an ascending plurality of rows of knit stitches further comprises using a single pronged transfer tool wherein a single knit stitch is picked up of off its respective knitting needle and transferred to a knitting needle spaced at least one knitting needle away from said knitted surrounding sidewall.

6. A method of manufacturing a knitted stocking cap with an aperture according to claim 3 further comprising a step of finishing off an aperture periphery of said aperture by using the crochet needle and said yarn to crochet a single chain about said aperture periphery.

* * * * *